US007866350B1

(12) United States Patent
Quigley

(10) Patent No.: US 7,866,350 B1
(45) Date of Patent: Jan. 11, 2011

(54) FORMING FABRIC FOR THE PRODUCTION OF A FIBROUS WEB MATERIAL

(75) Inventor: Scott Quigley, Bossier City, LA (US)

(73) Assignee: Voith Patent GmbH, Heidenheim (DE)

( * ) Notice: Subject to any disclaimer, the term of this patent is extended or adjusted under 35 U.S.C. 154(b) by 0 days.

(21) Appl. No.: 12/533,309

(22) Filed: Jul. 31, 2009

(51) Int. Cl.
*D03D 3/04* (2006.01)
*D03D 25/00* (2006.01)

(52) U.S. Cl. ..... 139/383 A; 139/383 AA; 139/383 R; 162/358.2

(58) Field of Classification Search ..... 139/383 R, 139/383 A, 383 AA, 408, 411, 412, 413, 139/414; 162/348, 358.1, 358.2, 900, 902, 162/903, 904
See application file for complete search history.

(56) References Cited

U.S. PATENT DOCUMENTS

2003/0024590 A1* 2/2003 Stone ..... 139/408
2004/0118473 A1* 6/2004 Hay et al. ..... 139/383 R
2004/0154683 A1* 8/2004 Majaury et al. ..... 139/383 A
2005/0067040 A1* 3/2005 Quigley ..... 139/383 A
2005/0103397 A1* 5/2005 Quigley et al. ..... 139/383 A
2006/0219312 A1* 10/2006 Hay et al. ..... 139/383 A
2006/0243339 A1* 11/2006 Hay ..... 139/421
2006/0260708 A1* 11/2006 Ueda et al. ..... 139/383 A
2008/0035231 A1* 2/2008 Hay et al. ..... 139/420 B

FOREIGN PATENT DOCUMENTS

EP 0432413 A1 6/1991
EP 1605095 A1 12/2005
WO 2006020414 A1 2/2006
WO 2008068317 A1 6/2008

* cited by examiner

*Primary Examiner*—Bobby H Muromoto, Jr.
(74) *Attorney, Agent, or Firm*—Taylor IP, P.C.

(57) ABSTRACT

A forming fabric for the forming of a fibrous web thereon, the fabric including a plurality of cross machine direction (CD) yarns and a plurality of machine direction (MD) yarns woven in a repeating pattern. The plurality of CD yarns includes a set of top CD yarns and a set of bottom CD yarns and a set of binder CD yarns. The plurality of MD yarns includes a set of top MD yarns and a set of bottom MD yarns. The top MD yarns being on a paper side of the fabric. The bottom MD yarns being on a wear side of the fabric. The repeating pattern of the CD yarns and the MD yarns include an arrangement of the bottom CD yarns each floating under only six adjacent bottom MD yarns and then between some of said top MD yarns and only two adjacent bottom MD yarns.

14 Claims, 11 Drawing Sheets

X - NON BINDER UPPER WEFT YARN

Y&Z - BINDER YARNS

- NON BINDER LOWER WEFT BETWEEN WARP YARNS

- BINDER Z WEFT ON MACHINE SIDE OF WARPS

- BINDER Y WEFT ON MACHINE SIDE OF WARPS

X - NON BINDER UPPER WEFT YARN

Y&Z - BINDER YARNS

- NON BINDER LOWER WEFT BETWEEN WARP YARNS

- BINDER Z WEFT ON MACHINE SIDE OF WARPS

- BINDER Y WEFT ON MACHINE SIDE OF WARPS

FORMING FABRIC FOR THE PRODUCTION OF A FIBROUS WEB MATERIAL

BACKGROUND OF THE INVENTION

1. Field of the Invention

The present invention relates to a forming fabric for use with a machine for the production of a fibrous web material, and, more particularly, to a forming fabric used in a papermaking process, for example, in a forming section of a papermaking machine.

2. Description of the Related Art

In the production of a fibrous web material, such as paper, it is generally required that a fine structuring be present in the web material contact side of a fabric belt. That is to say, the side that the fibrous web material is in direct contact with should have a fine structuring in order to avoiding any marking effects. The desirable property on the wear side or machine side of the fabric belt is such that wear and abrasion should be reduced as much as possible so that the machine side, which is in contact with various rollers for deflecting and advancing the web material should be configured to keep wear and tear to a minimum.

A composite fabric for papermaking machines is known from European Patent Application No. EP 0 432 413 A1, wherein two fabric layers are on top of each other, having two transverse threads arranged directly on top of each other is described. The number of transverse threads of the layer on the paper side corresponds to the number of transverse threads of the layer on the machine side of the fabric. Threads extending in the longitudinal direction of the fabric are incorporated to both fabric layers, and alternate on the crossing points between both fabric layers in order to create a structural connection between the layers.

In International Publication No. WO 2006/020414 A1, there is disclosed a fabric for a paper machine, having two fabric layers positioned on top of each other including warp and weft yarns. The number of weft yarns in the fabric layer on the paper side is twice as high as the number of warp yarns in the fabric layer on the running or machine side.

In International Publication No. WO 2004/085740 A1, there is disclosed a fabric belt for a papermaking machine, wherein the connection between two fabric layers is carried out by way of warps that are structurally incorporated and alternating at crossing points between the fabric layers. The fabric layers further include layers of weft yarns, wherein the number of weft yarns in the fabric layer on the paper side is twice as large as the number of weft yarns in the fabric layer on the running or machine side.

A fabric belt for a paper machine is also known from European Patent Application EP 1 605 095 A1, wherein both fabric layers are embodied with threads extending in the longitudinal belt direction, wherein the number of threads in the fabric layer on the running side is twice as large as that in the fabric layer on the paper side. The connection of both fabric layers is carried out by way of the structurally binding threads extending in the longitudinal direction and transfer threads alternating between the fabric layers.

What is needed in the art is a forming fabric for machines for the production of a fibrous web material that has a high degree of wear resistance and increased seam strength.

SUMMARY OF THE INVENTION

The present invention provides a forming fabric for a papermaking machine for the production of a fibrous web, particularly paper or cardboard.

The present invention consists in one form of a forming fabric for the forming of a fibrous web thereon, the fabric including a plurality of Cross machine Direction (CD) yarns and a plurality of machine direction (MD) yarns used in a repeating pattern. The plurality of CD yarns includes a set of top CD yarns, a set of bottom CD yarns, and a set of binder CD yarns. The plurality of MD yarns includes a set of top machine direction yarns and a set of bottom machine direction yarns. The top machine direction yarns are on a paper side of the fabric. The bottom machine direction yarns are on a wear side of the fabric. The repeating pattern of the CD yarns and the MD yarns includes an arrangement between the bottom CD yarns, each floating under only six adjacent bottom machine direction yarns and then between some of the top machine direction yarns and only two adjacent bottom machine direction yarns.

An advantage of the present invention is that there is increased interweaving of the MD and CD yarns in the fabric structure by doubling the amount of warp or MD knuckles on the wear side over the prior art.

Another advantage of the present invention is that each wear side warp knuckle pairs with an adjacent wear side warp knuckle to maintain knuckle length.

Yet another advantage of the present invention is that the pairing of knuckles allows for deeper crimping into the bottom CD for increased cross direction stability.

Still yet another advantage of the present invention is that it allows for the use of larger bottom CD yarns.

Still yet another advantage of the present invention is that the increased interweaving allows for greater seam strength of the fabric.

BRIEF DESCRIPTION OF THE DRAWINGS

The above-mentioned and other features and advantages of this invention, and the manner of attaining them, will become more apparent and the invention will be better understood by reference to the following description of embodiment of the invention taken in conjunction with the accompanying drawings, wherein.

Corresponding reference characters indicate corresponding parts throughout the several views. The exemplifications set out herein illustrate one embodiment of the invention and such exemplifications are not to be construed as limiting the scope of the invention in any manner.

DETAILED DESCRIPTION OF THE INVENTION

Figure 1A:
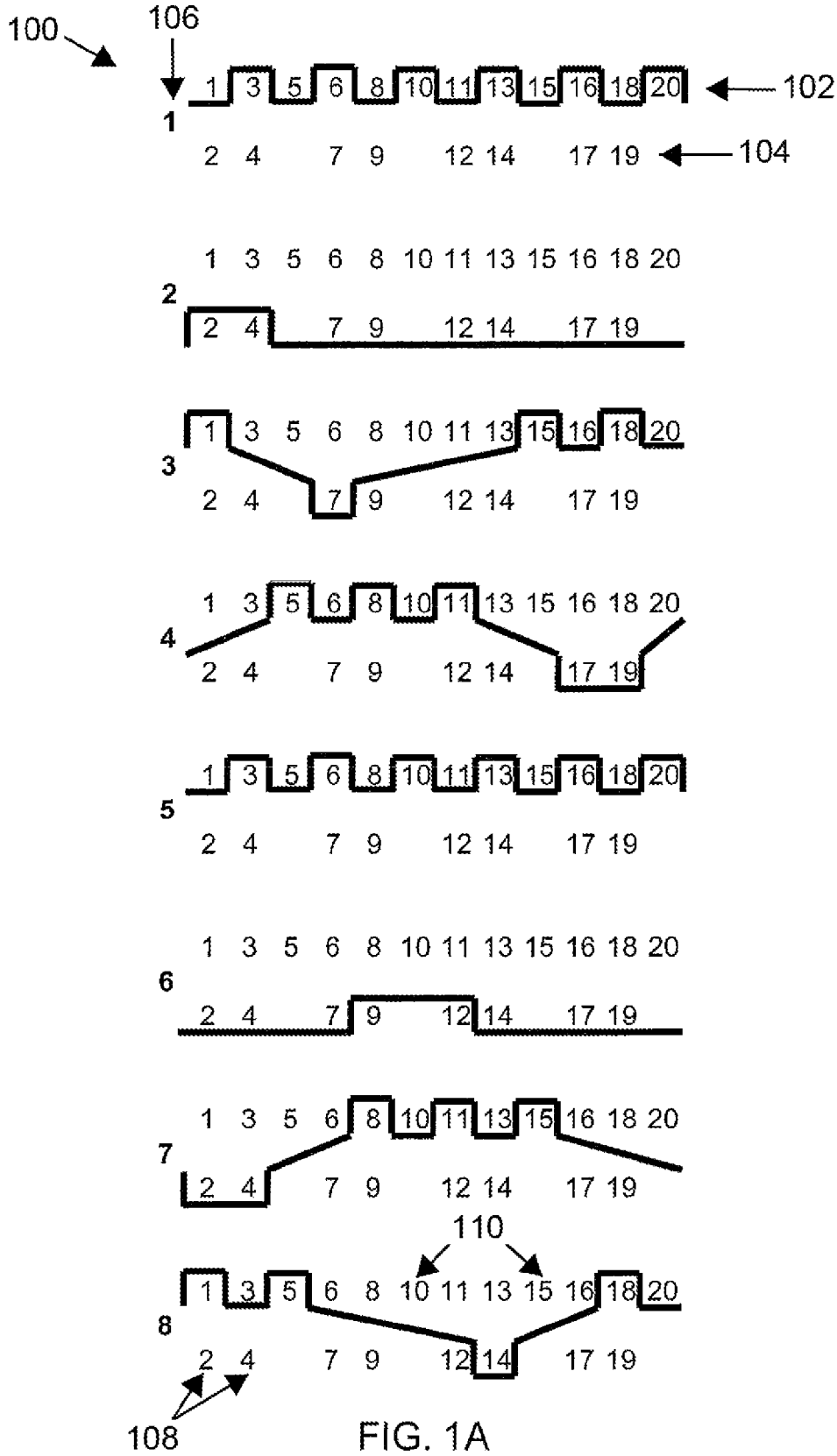
FIGS. 1A-1D are cross sectional schematic diagrams illustrating formation of an embodiment of the fabric of the present invention.
Figure 1B:
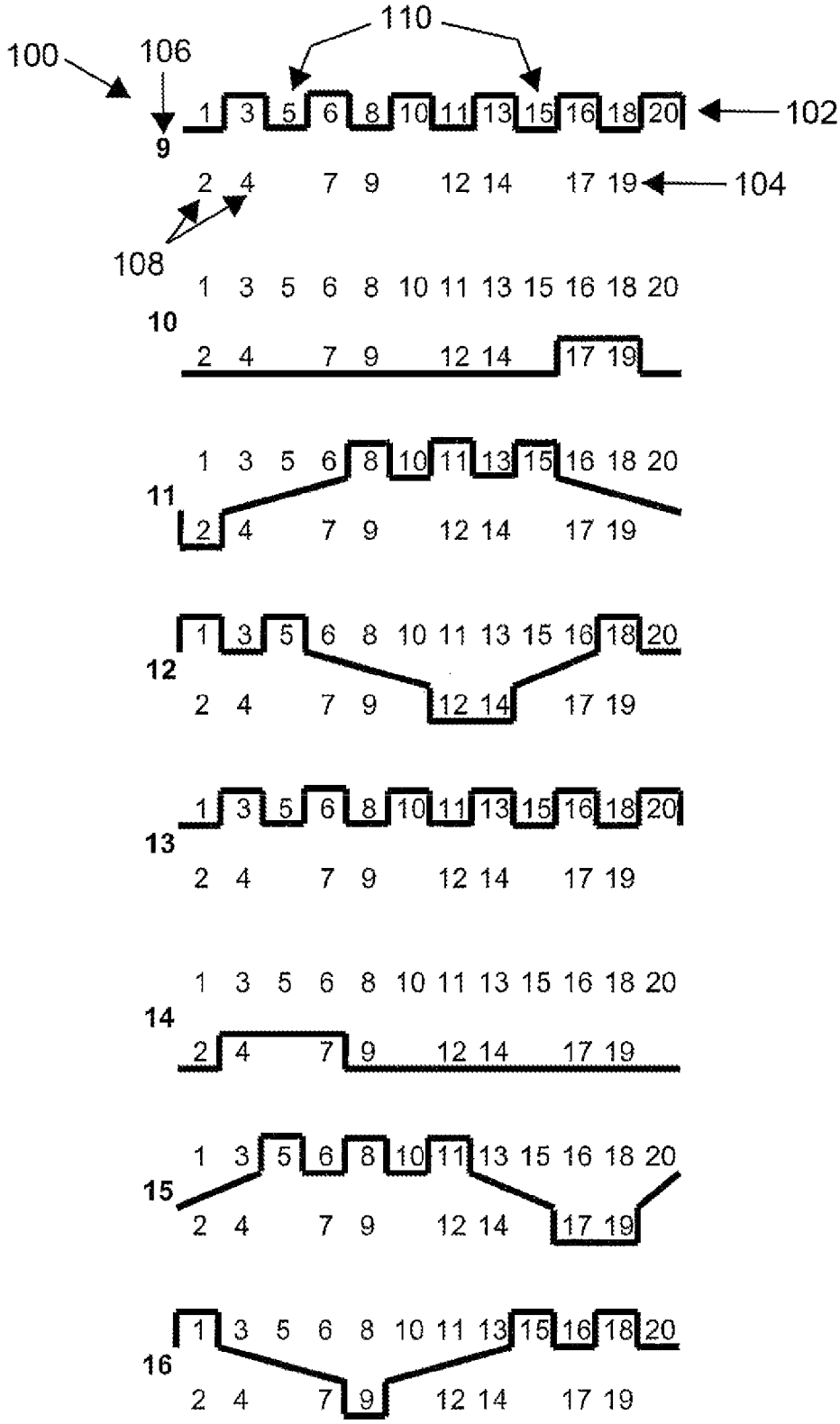
Figure 1C:
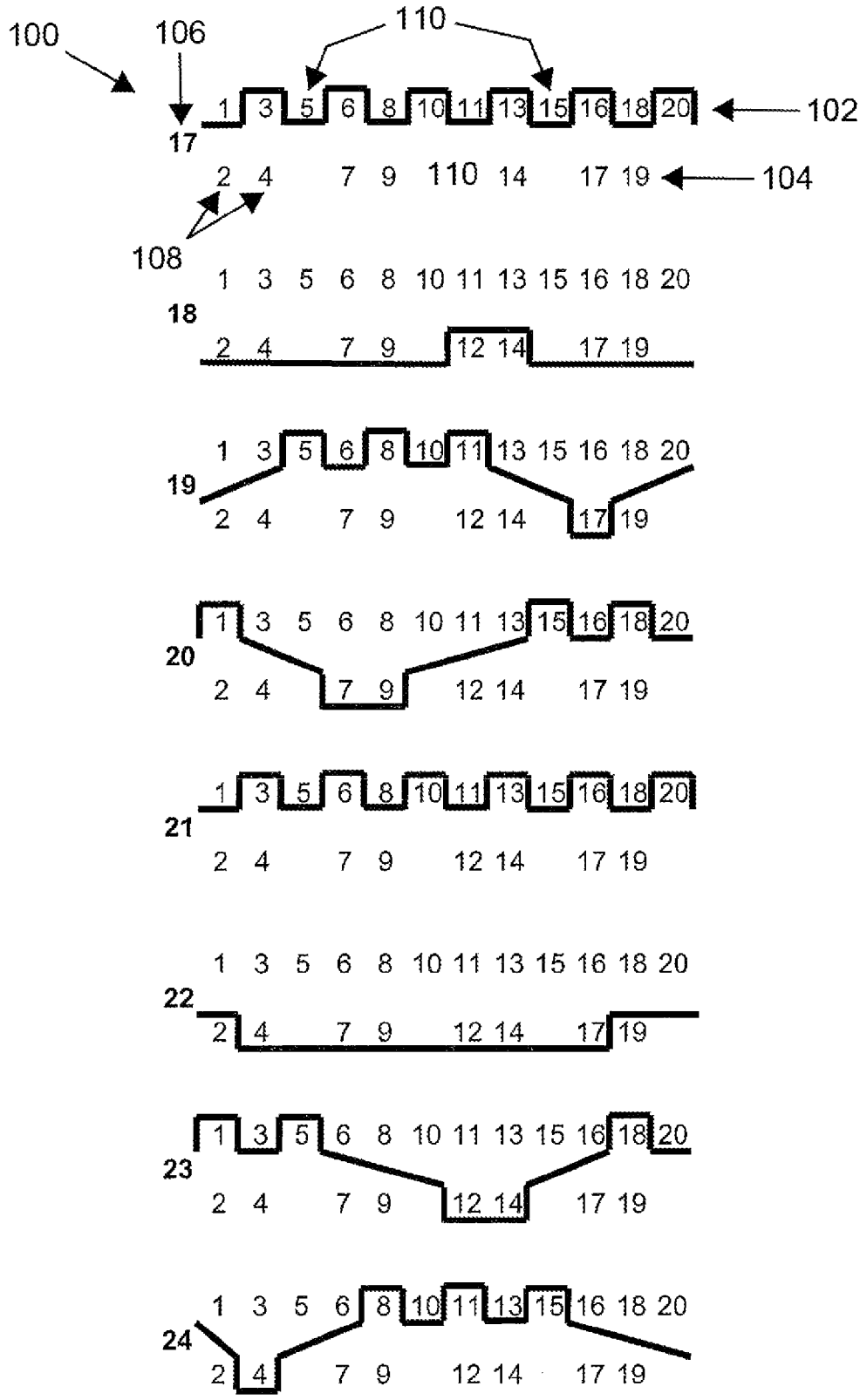
Figure 1D:
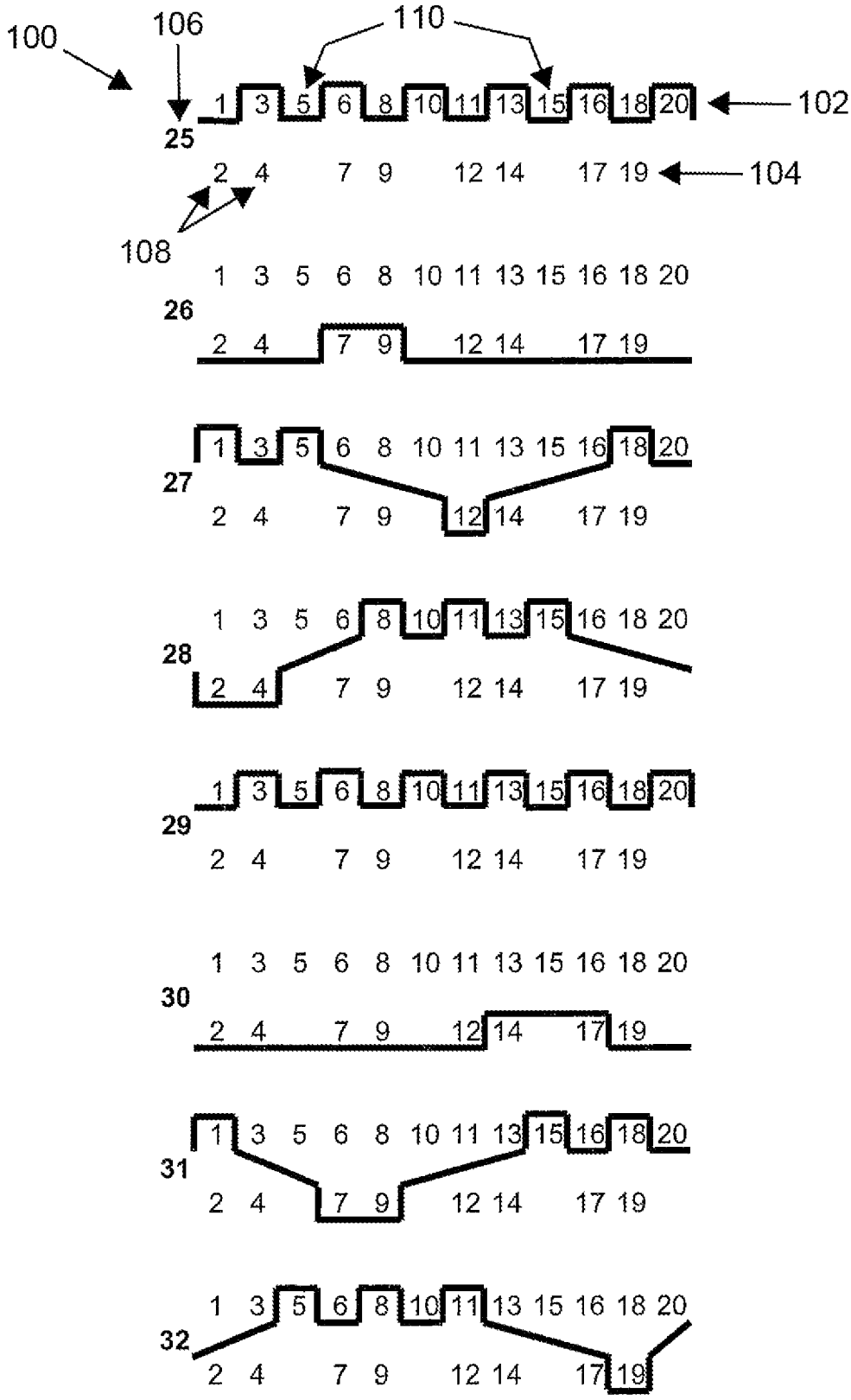
Figure 2A:
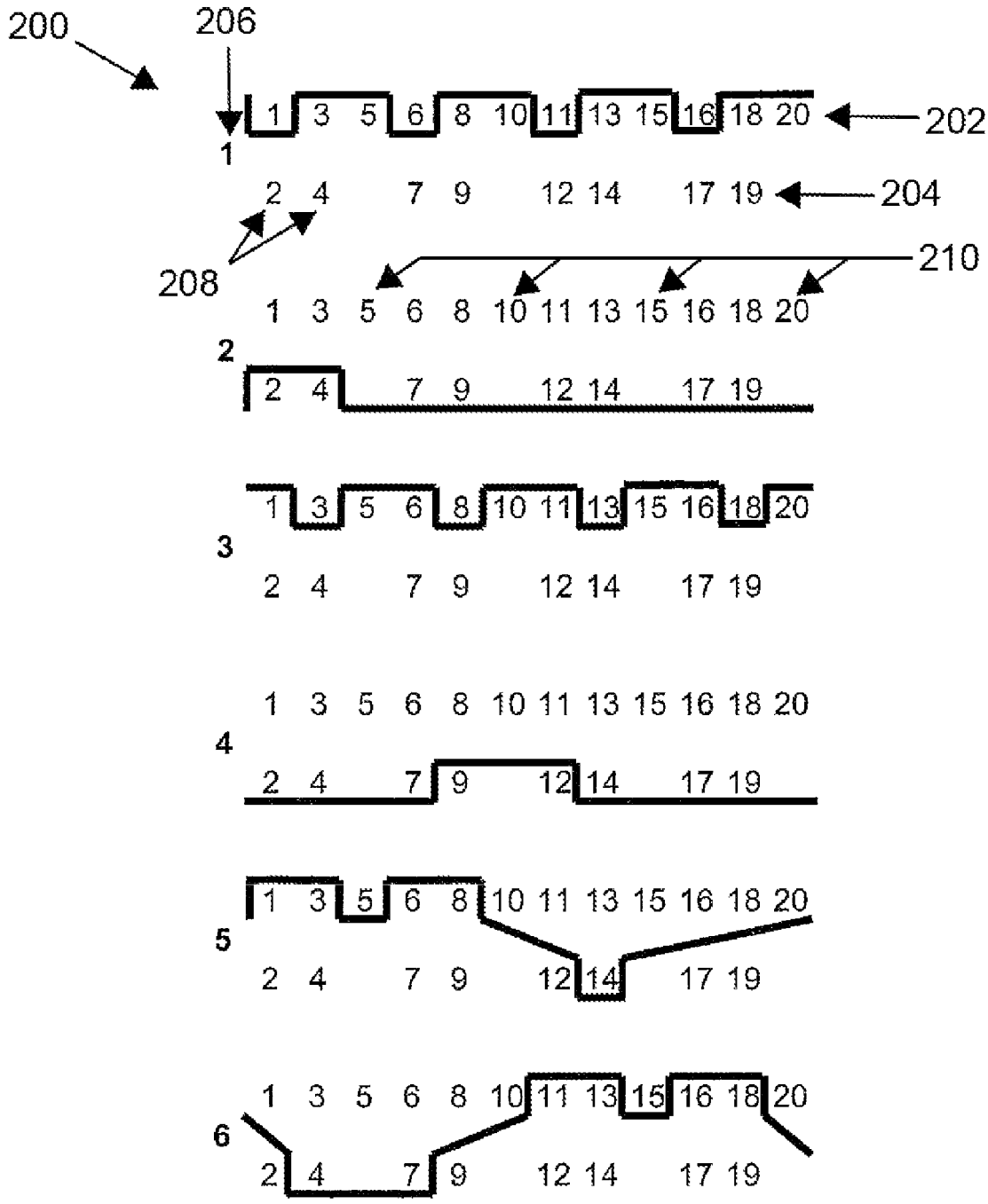
FIGS. 2A-2D are cross sectional schematic diagrams illustrating another embodiment of the fabric of the present invention.
Figure 2B:
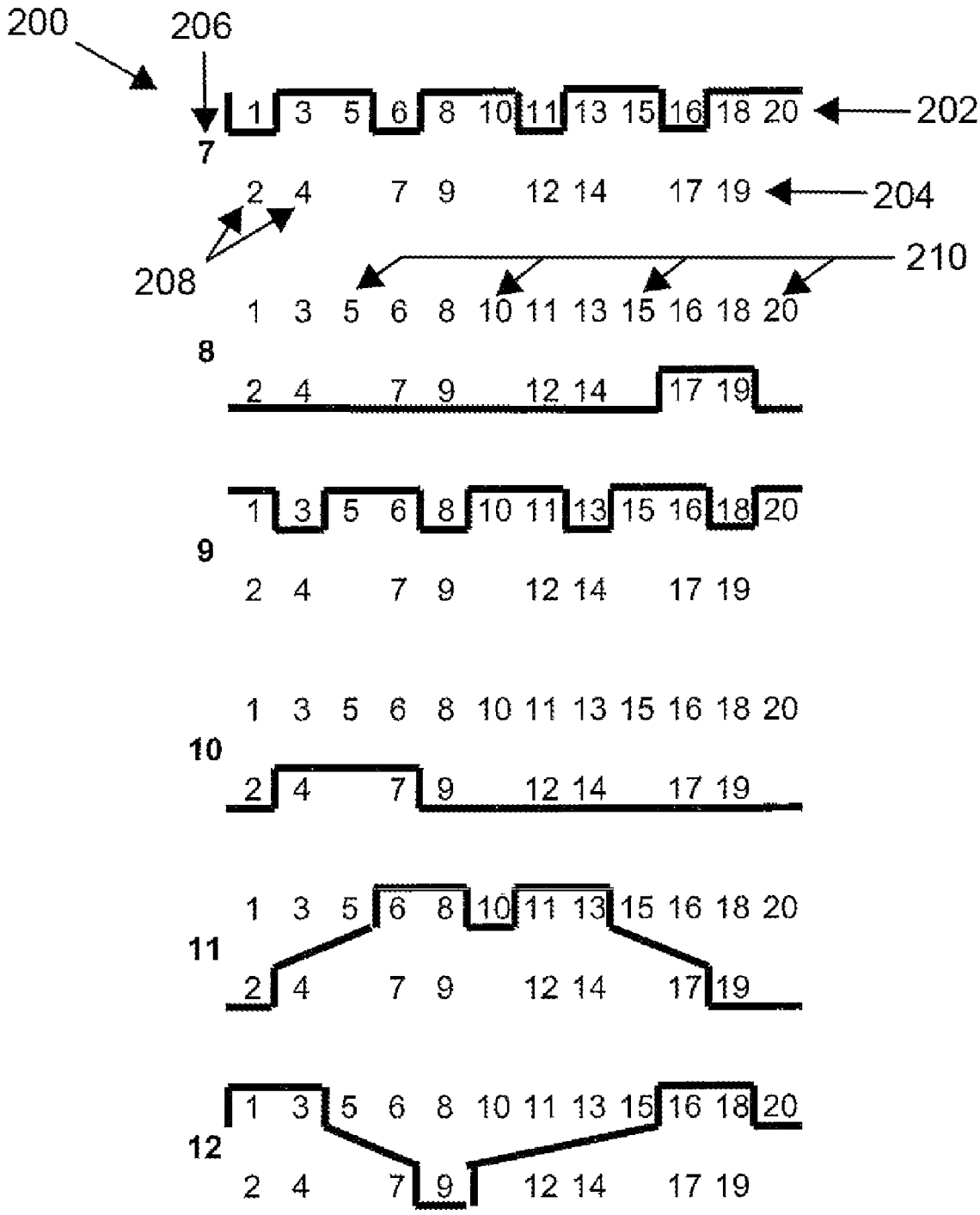
Figure 2C:
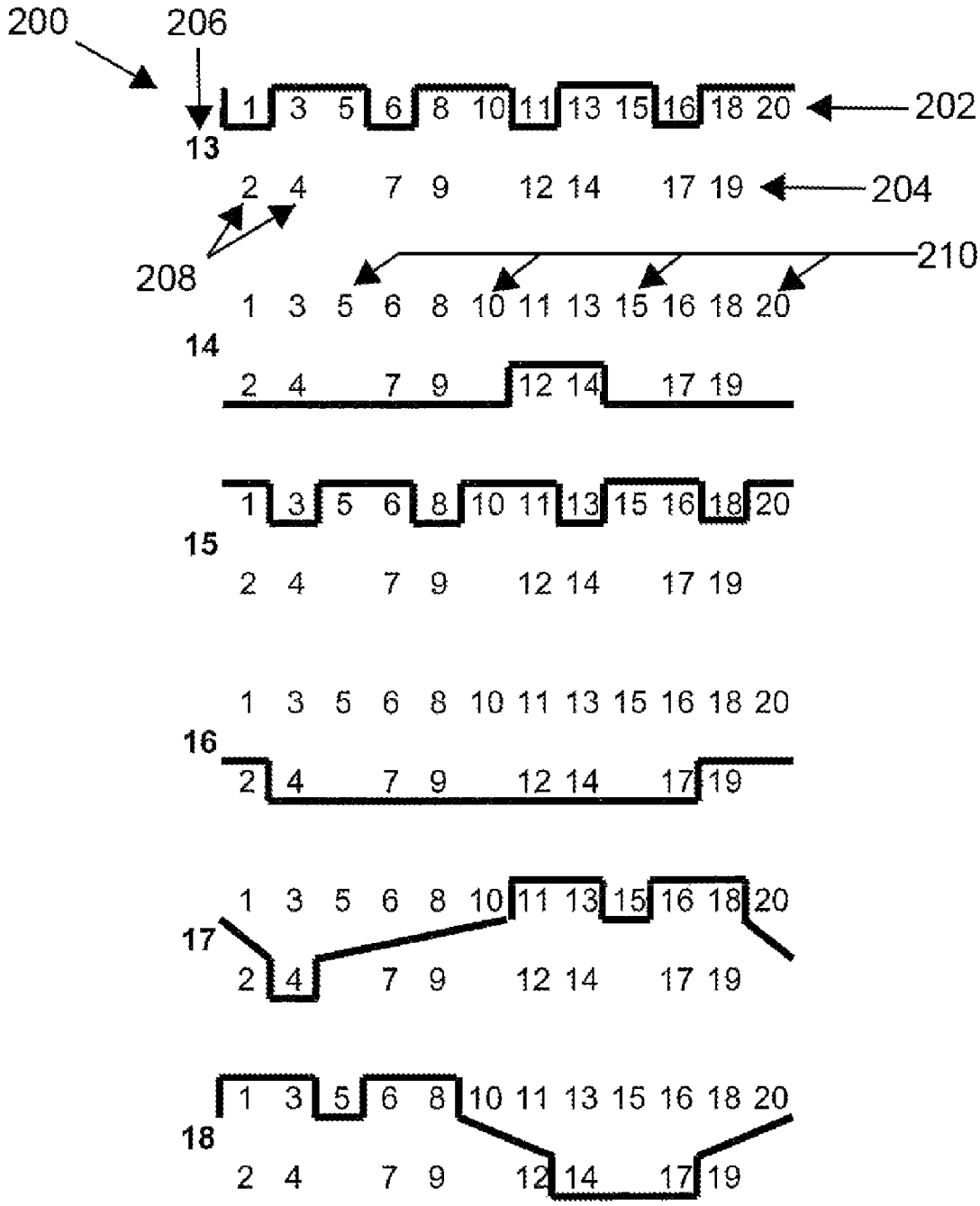
Figure 2D:
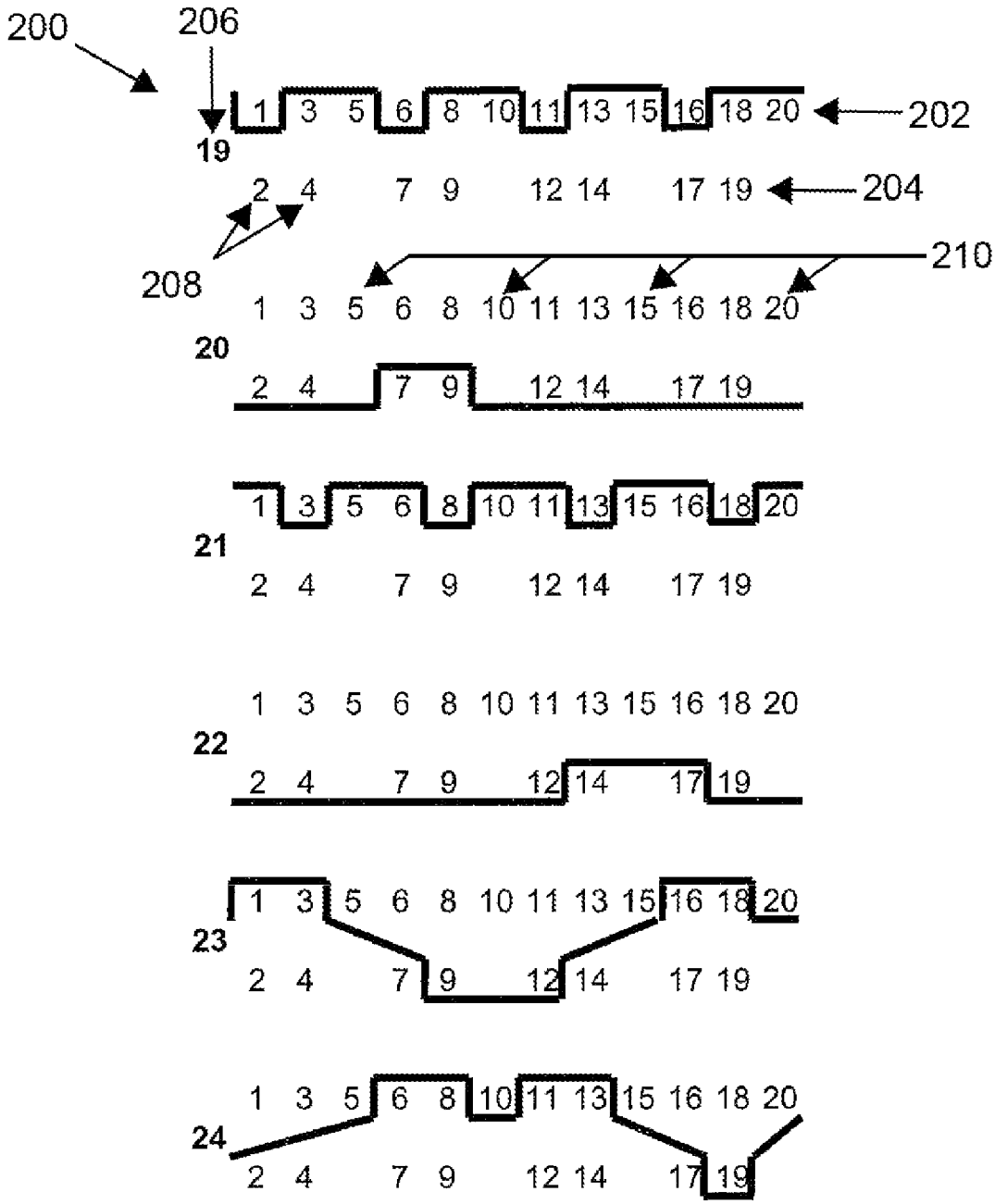

Referring now to the drawings, and more particularly to FIGS. 1A through 1D, there is illustrated in schematic form a weave pattern for a forming fabric used in a papermaking machine for the production of a fibrous web. Fabric 100 includes warp and weft yarns interwoven on a textile loom. Fabric 100 may be woven flat or in an endless form. Fabric 100 includes a first layer of Machine Direction (MD) yarns 102 and a second layer of MD yarns 104, the MD yarns being represented by numbers 1-20 in the figures. For the sake of convenience, the Cross machine Direction (CD) yarns are also numbered but it is clear from the illustrations that the CD yarns are the continuous lines which are numbered to the left of each set of MD yarns with numbers 1-32. Although the term "yarn" is used throughout, it is to be understood that monofilament and multifilament structures are included therein. Also, the yarn sizes can vary from one another.

The layers of MD yarns 102 and 104 include MD yarns that are paired, such as paired MD yarns 108 and unpaired MD yarns 110. Paired MD yarns 108 include MD yarns 1 and 2; 3 and 4; 6 and 7; 8 and 9; 11 and 12; 13 and 14; 16 and 17; and 18 and 19. Unpaired MD yarns 110 include MD yarns 5, 10, 15 and 20. The schematic illustration of MD yarns as numbers with their positions shown for schematic purposes is to illustrate the weave pattern. In the actual fabric, some shifting of the MD and CD yarns certainly occurs and the stacked arrangement between the MD yarns may be altered in the woven fabric from the distinct structure shown in the weave patterns illustrated herein. This is to say that the weave patterns illustrate how the fabric is woven and to illustrate the advantages thereof.

CD yarns 106 include top CD yarns 1, 5, 9, 13, 17, 21, 25 and 29. Bottom CD yarns are 2, 6, 10, 14, 18, 22, 26 and 30. Binder CD yarns are 3, 4, 7, 8, 11, 12, 15, 16, 19, 20, 23, 24, 26, 27, 31 and 32. The top CD yarns are CD yarns which are woven only with MD yarns in layer 102 and bottom CD yarns are those woven only with MD yarns of layer 104. Binder CD yarns are woven with both first MD layer yarns 102 and second MD layer yarns 104.

Now, additionally referring to FIGS. 2A-2D, there is illustrated another embodiment of the weave pattern of the present invention which is illustrated as a fabric 200 having attributes similar to fabric 100 with each similar element increased by a factor of 100 in the numbering systems. Whereas fabric 100 has 20 MD yarns and 32 CD yarns in the repeating pattern, fabric 200 has a similar selection in the sequencing of MD yarns, but only has 24 CD yarns. In fabric 200, the top CD yarns are 1, 3, 7, 9, 13, 15, 19, and 21. The bottom CD yarns are 2, 4, 8, 10, 14, 16, 20, and 22. The binder CD yarns are 5, 6, 11, 12, 17, 18, 23, and 24.

Figure 3:
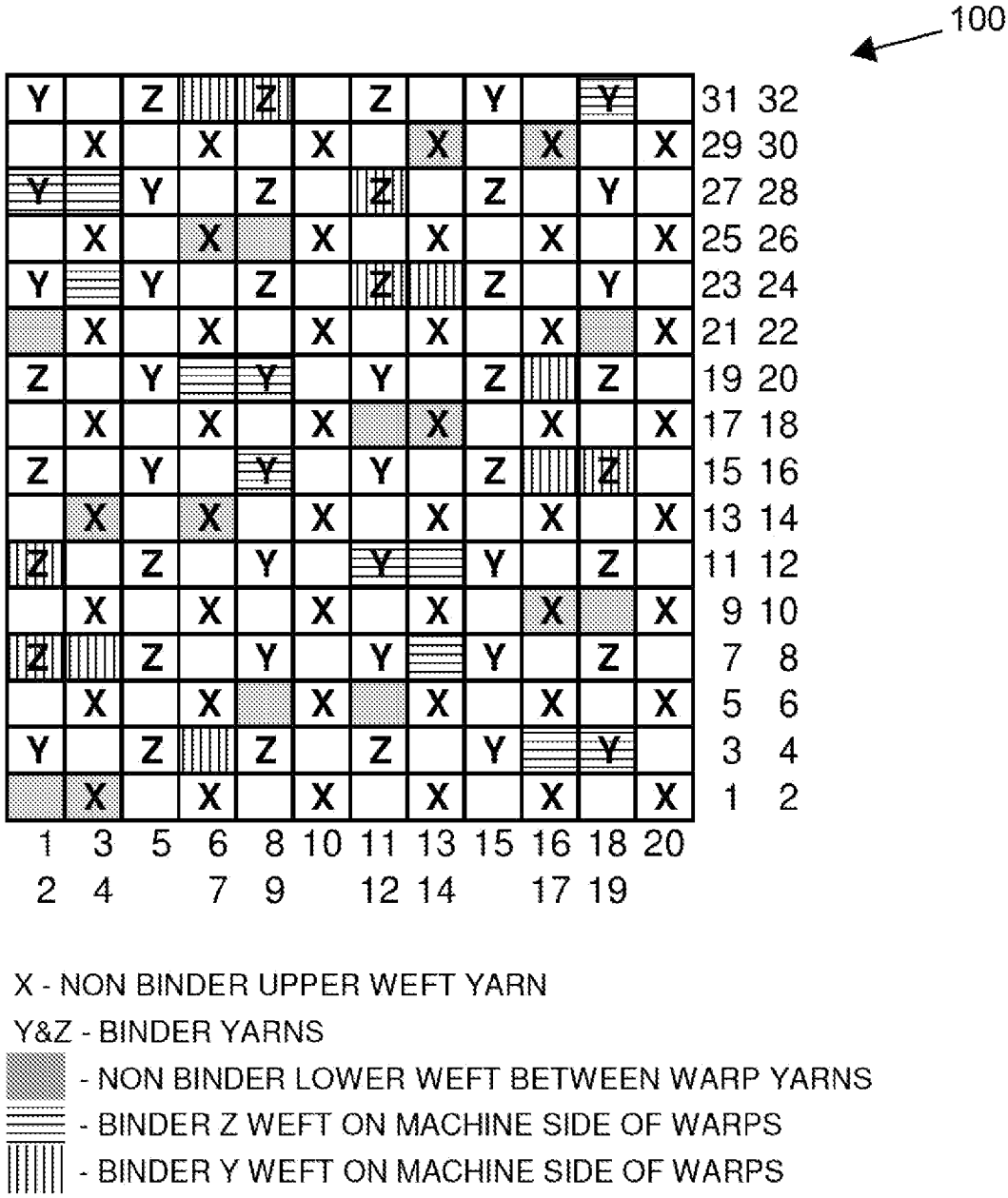
FIG. 3 is a schematic view looking down on the paper side of the embodiment of FIGS. 1A-1D.
Figure 4:
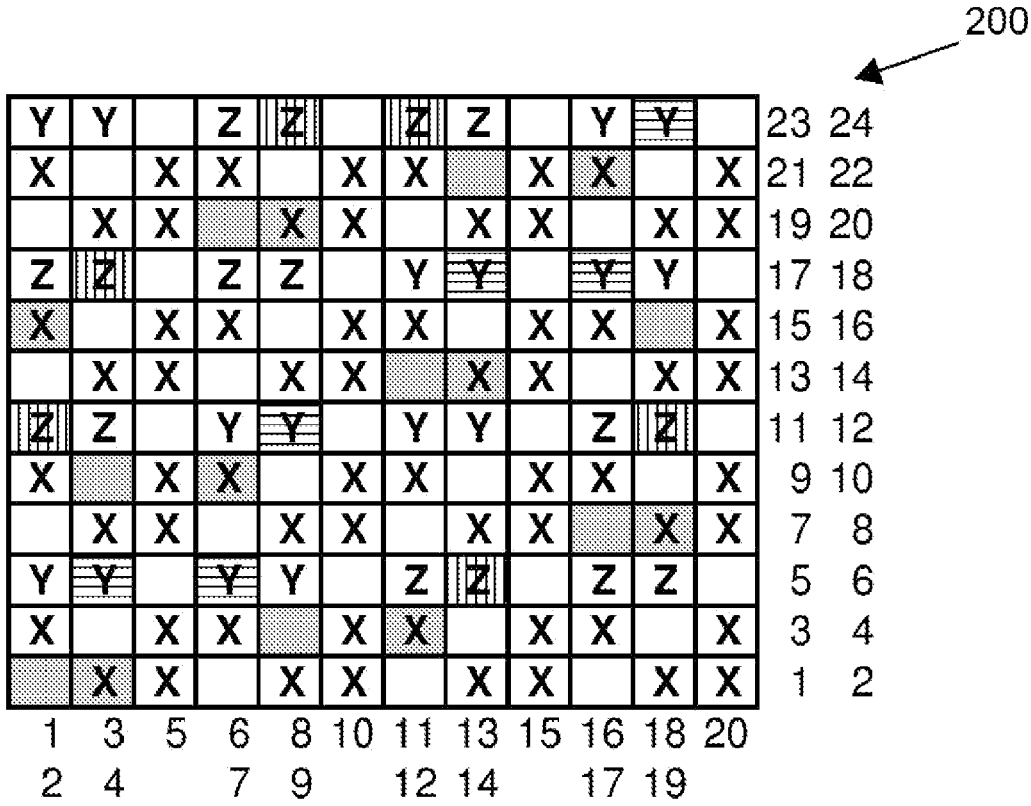
FIG. 4 is a schematic top view looking down onto the paper side of the fabric of FIGS. 2A-2D.

Now, additionally referring to FIGS. 3 and 4, there is illustrated a view of the weave patterns respectively of FIGS. 1A-1D and FIGS. 2A-2D reflected therein. In FIGS. 3 and 4, the "X's" illustrate the non-binder upper CD yarns when they are above (on the paper side of) the first upper MD yarn layer 102 and 202. The letters Y and Z represent the binder yarns when they are above the upper, first MD layer yarns 102 and 202 respectively. The gray shading represents when the lower, bottom CD yarns are between paired MD yarns 108 and 208 respectively. The squares containing the horizontal and vertical lines therein illustrate the various points when the binder CD yarns are on the machine side of the lower second MD yarn layer 104.

Figure 5:
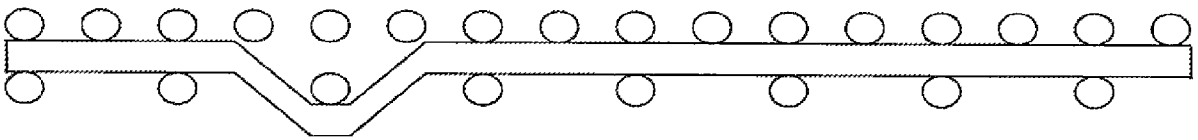
FIG. 5 is a schematic view of the machine direction fabric of the prior art illustrating one warp knuckle for each eight bottom weft yarns.
Figure 6:
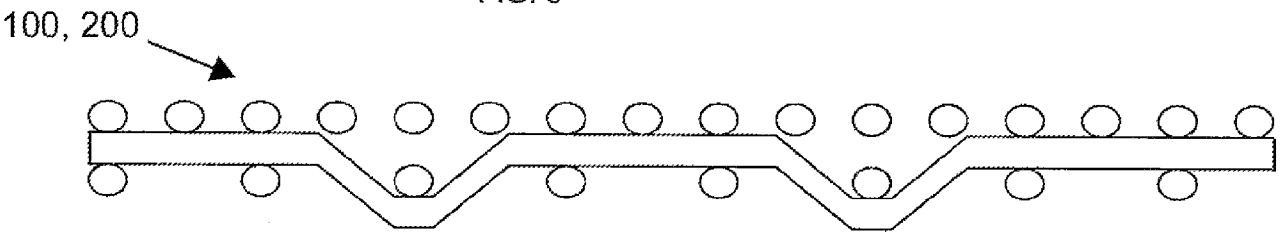
FIG. 6 is a machine direction cross sectional schematic of the present invention illustrating two warp knuckles for every eight bottom weft yarns.
Figure 7:
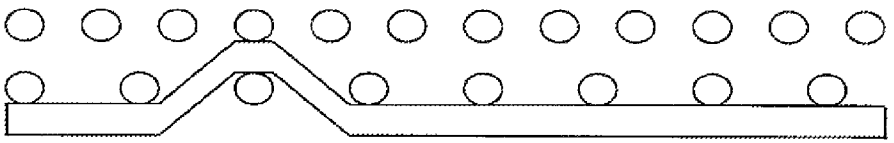
FIG. 7 is a cross directional cross sectional schematic view of the prior art illustrating the bottom weft yarn being crimped by only one warp yarn per repeating pattern.
Figure 8:
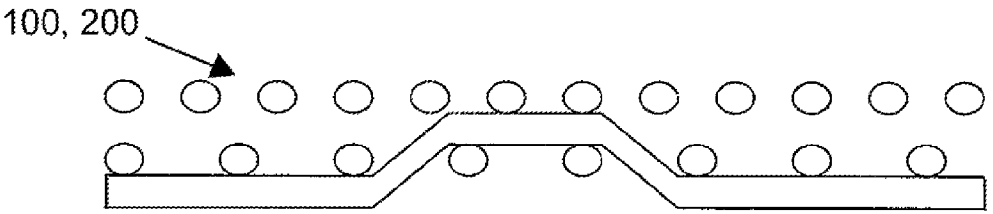
FIG. 8 is a cross directional cross sectional schematic view of the present invention illustrating that the bottom weft yarn is crimped by a pair of warp yarns for each pattern repeat.

In both FIGS. 3 and 4, the numbers along the bottom of the matrix represent the numbered MD yarns and the numbers along the right side of the matrix represent the numbered CD yarns that each represent the repeating pattern of the present invention. The machine direction yarns, also known as the MD yarns, and the CD yarns, also known as the cross machine direction yarns, of the present invention have increased interweaving of the MD and CD yarns over the prior art. This doubles the amount of MD knuckles on the wear side as can be seen in FIGS. 5-8. FIGS. 5 and 7 illustrate a prior art weave pattern showing the machine direction cross section in FIG. 5 and the cross direction cross section in FIG. 7. Only one warp or MD knuckle is produced for every eight bottom CD yarns as shown in FIG. 5 with the bottom CD being crimped by only one MD yarn as illustrated in FIG. 7 per repeat pattern. In the present invention, the machine direction cross sectional view in FIG. 6, and the cross directional view in FIG. 8 illustrate that there are two warp or MD knuckles for every eight bottom CD yarns and that the bottom CD yarn is crimped by a pair of MD yarns for each pattern repeat. This leads to a deeper MD yarn burial and the ability to crimp a larger CD yarn for greater life potential of the fabric.

Each wear side MD or warp knuckle pairs with an adjacent wear side MD or warp knuckle to maintain knuckle length. The pairing of the knuckles also allows deeper crimping into the bottom CD for increased cross directional stability. This construct also allows the use of larger bottom CD yarns to amplify the benefits. The increased interweaving of this inventive weave pattern allows for greater seam strength in the fabric.

In fabric 100, the top CD yarns are simple weave pattern weaving alternately around each of the first layer MD yarns 102. The bottom CD yarns go only under only two adjacent lower CD yarns 104 and over only six adjacent MD yarns in its repeating pattern. Also, every other bottom CD yarn goes between two paired MD yarns only. The other bottom CD yarn, while going between two paired MD yarns, also passes an unpaired MD yarn between the paired MD yarns. This construct of the bottom CD yarns is also illustrated in fabric 200. In fabric 100, the binder yarns have a simple weave over three of the upper MD yarns and engages one lower MD yarn with the adjacent binder yarn engaging two of the lower MD yarns.

In fabric 200, upper CD yarns have a pattern of going above only two MD yarns, then under one MD yarn and then repeating going above two MD yarns in a continuing fashion. Bottom CD yarns are described above and are common in the weave patterns having alternately passing an unpaired MD yarn and the other bottom CD yarn going only between two paired MD yarns. The binder CD yarns of fabric 200 also alternately pass over one bottom MD yarn and two bottom MD yarns and then engage the upper MD yarns similar to the upper CD yarns.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A forming fabric for the forming of a fibrous web thereon, the fabric comprising:

a plurality of cross machine direction (CD) yarns including a set of top CD yarns, a set of bottom CD yarns and a set of binder CD yarns; and a plurality of machine direction (MD) yarns including a set of top MD yarns and a set of bottom MD yarns, said top MD yarns being on a paper side of the fabric, said bottom MD yarns being on a wear side of the fabric;

a repeating pattern of said CD yarns and said MD yarns, said pattern including an arrangement of said bottom CD yarns each floating under only six adjacent bottom MD yarns and then between some of said top MD yarns and only two adjacent bottom MD yarns, said set of top MD yarns and said set of bottom MD yarns total 20 in each said repeating pattern, every bottom MD yarn is paired with a top MD yarn defining paired MD yarns, some of said top MD yarns not being paired with a bottom MD yarn to define an unpaired top MD yarn, in said pattern half of said bottom CD yarns pass only between paired MD yarns and the other half of said bottom CD yarns pass between two paired MD yarns and past an unpaired top MD yarn.

2. The fabric of claim 1, wherein said set of CD yarns in each said repeating pattern number 32.

3. The fabric of claim 2, wherein each said bottom CD yarn is adjacent to four of said binder CD yarns at some part of said pattern.

4. The fabric of claim 1, wherein said set of CD yarns in each said repeating pattern number 24.

5. The fabric of claim 4, wherein each said bottom CD yarn is adjacent to two of said binder CD yarns along some part of said pattern.

6. The fabric of claim 5, wherein each said bottom CD yarn is adjacent to another of said bottom CD yarns along some part of said pattern.

7. The fabric of claim 1, wherein said set of binder CD yarns include binder yarn pairs, each binder yarn in a binder pair being sequentially simple woven with five sequential top MD yarns over three said top MD yarns and under two said top MD yarns.

8. The fabric of claim 7, wherein one yarn of said binder yarn pair is woven around only one of said bottom MD yarns, the other yarn of said binder yarn pair passing around two adjacent of said bottom MD yarns.

9. The fabric of claim 1, wherein said set of top MD yarns consist of 12 yarns, and said set of bottom MD yarns consist of 8 yarns per said repeating pattern.

10. The fabric of claim 9, wherein said set of binder CD yarns are a set of paired CD yarns.

11. The fabric of claim 10, wherein said set of top CD yarns consist of 8 yarns, said set of bottom CD yarns consist of 8 yarns and said set of binder CD yarns consist of 16 yarns per said repeating pattern.

12. The fabric of claim 11, wherein one of said top CD yarns and one of said bottom CD yarns are positioned having one said pair of CD yarns on each side.

13. The fabric of claim 10, wherein said set of top CD yarns consist of 8 yarns, said set of bottom CD yarns consist of 8 yarns and said set of binder CD yarns consist of 8 yarns per said repeating pattern.

14. The fabric of claim 13, wherein two of said top CD yarns and two of said bottom CD yarns are positioned having one said pair of CD yarns on each side.

* * * * *